US005787593A

United States Patent [19]

Althaus

[11] Patent Number: 5,787,593

[45] **Date of Patent: *Aug. 4, 1998**

[54] PIVOTING SHAVING SYSTEM

[75] Inventor: Wolfgang Althaus, Wuppertal, Germany

[73] Assignee: Warner-Lambert Company, Morris Plains, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 564,609

[22] Filed: Nov. 29, 1995

[51] Int. Cl.[6] ..... B26B 21/14

[52] U.S. Cl. ..... 30/527; 74/110; 74/520; 403/322

[58] Field of Search ..... 30/50, 57, 58, 30/61, 87, 89; 74/110, 520; 403/322

[56] References Cited

U.S. PATENT DOCUMENTS

| | | | |
|---|---|---|---|
| 1,247,581 | 11/1917 | Seitz | 30/89 |
| 1,639,441 | 8/1927 | Spahr | 30/89 |
| 3,935,639 | 2/1976 | Terry . | |
| 3,950,848 | 4/1976 | Goldstein | 30/89 |
| 3,964,160 | 6/1976 | Gordon | 30/89 |
| 4,083,104 | 4/1978 | Nissen et al. | 30/89 |
| 4,253,235 | 3/1981 | Jacobson | 30/87 |
| 4,275,498 | 6/1981 | Ciaffone | 30/47 |
| 4,492,025 | 1/1985 | Jacobson | 30/57 |
| 4,797,997 | 1/1989 | Packham et al. | 30/89 |
| 4,797,998 | 1/1989 | Motta | 30/87 |
| 5,050,301 | 9/1991 | Apprille, Jr. . | |
| 5,535,518 | 7/1996 | Althaus | 30/89 |

FOREIGN PATENT DOCUMENTS

| | | |
|---|---|---|
| 2116470 | 9/1982 | United Kingdom . |
| WO 9320983 | 10/1993 | WIPO . |

*Primary Examiner*—Maurina T. Rachuba
*Attorney, Agent, or Firm*—Charles W. Almer

[57] ABSTRACT

The present invention is directed to a razor comprising a handle, a razor blade unit having one or more razor blades which can be connected to the front end of the handle, and a connecting device for connecting the razor blade unit to the handle, such that the shaving results are improved for normal shaves as well as for specific applications like medical pre-operation shave. The razor blade unit of the present invention is mounted such that it can swivel relative to the handle about a swivel axis which intersects the cutting edge of the razor blade.

17 Claims, 8 Drawing Sheets

PIVOTING SHAVING SYSTEM

FIELD OF THE INVENTION

The present invention relates to a razor comprising a handle, a razor blade unit which can be connected to the front end of the handle, in particular a razor-blade unit with at least one razor blade, and a connecting device for connecting the razor blade unit to the handle.

BACKGROUND OF THE INVENTION

Razors of the generic type are known from the prior art. Generally razors comprise a razor head which is formed by a plastic housing and a razor-blade assembly arranged thereon, which assembly is commonly designated a razor blade unit and is usually at the front end of a handle. In the case of a fixed connection between the handle and the razor-blade unit, the razor head may exclusively comprise a razor-blade assembly. If, however, the razor blade unit can be separated from the handle, then the razor blade unit comprises both plastic-housing elements and a razor-blade assembly connected thereto. For its part, said razor-blade assembly comprises a single or double razor blade. Razors of the generic type are usually mass-produced articles which are used for daily shaving or for cosmetic hair removal. Such razors may, however, also be used in the medical sector.

Since the areas of the body which are to be shaved are known to be irregularly shaped, the prior art has already proposed a series of measures in order to design the blade guidance to be flexible relative to the skin which is to be shaved. Consequently, pivot joints which are arranged in the handle region are known, as are flexible blades and razor blades which are used in razor-blade assemblies such that they can move in the cutting-edge plane.

In a known prior system, the razor blade unit is arranged swivellably on the holder, the swivel axis lying essentially parallel to the cutting edges, but in front of the razor blade unit. Consequently, in addition to large swivelling movements, uncontrollable moments also take effect, which may, in adverse cases, result in cuts. In a further known system, the swivel axis lies beneath the razor-blade plane, which can result in the same disadvantageous effects. Finally, a system is known in which the razor blade unit is mounted in a bearing shell opposite the handle, which, in addition to large swivel displacements and uncontrollable moments, also results in manufacturing advantages and disadvantages in operation due to possible contamination and the like.

All the measures proposed in the prior art are intended to improve the shaving results through the cutting edges of the blades being brought up as closely as possible to the surface which is to be shaved. Although the known systems permit the razor blades to move relative to the skin which is to be shaved, it is not ensured that the razor blades actually follow the skin which is to be shaved while utilizing the greatest possible cutting width and maintaining the best possible cutting angle.

SUMMARY OF THE INVENTION

The object of the present invention is to develop a razor of the generic type such that it can be swivelled relative to the handle about a swivel axis which intersects the cutting edge of the razor blade. The configuration according to the present invention ensures the blades are guided very closely to the surface which is to be shaved and that skin contours are followed to the optimum extent. Due to the capacity of the razor blade unit to swivel about a swivel axis which intersects the cutting edge, the blade can also be guided closely along the skin which is to be shaved in areas of the body which are very irregular and very inaccessible, with the result that a good shave is ensured. Slipping can, in practice, be voided, and movements in the cutting-edge longitudinal direction can be reduced to a minimum. Advantageously, the razor-blade assembly can be swivelled in the two pivot directions through an angle of 0° to 80°, preferably through an angle of 5° to 20°. It is advantageously proposed that the razor blade unit has a double razor blade assembly. The capacity for swivelling according to the invention can be combined to good effect with conventional movement mechanisms, with the result that corresponding shaving results can be achieved depending on requirements.

It should be especially noted within the context of the present invention that the swivel axis about which the razor blade unit is mounted such that it can be swivelled, in the manner according to the invention, does not have to intersect the cutting edge of the razor blade with mathematical precision, which would be inconsistent with the tolerances which are conventional in the production of mass-produced articles. The essential factor is that the swivel axis lies in a direction which intersects the cutting edge of the razor blade and that it runs within a range, given by the tolerances, about the cutting edge of the razor blade. It is thus not a matter of the mathematically correct production of the point of intersection at a single location, which would not be precisely defined by the concept of the cutting edge in any case, but of the positioning of a directionally fixed swivel axis in a range which is expedient from production viewpoints.

The configuration according to the invention effects a situation where the razor blade unit and thus the razor blades, arranged therein, can be swivelled with the associated cutting edges and contours can thus be followed. According to the invention, the swivel axis intersects the cutting edge of the razor blade, in particular it intersects cutting edge of the razor blade relatively perpendicularly and generally in the center thereof. The resulting swivel movement thus effects the situation where the razor blades remain in their pan, but can be swivelled about an essentially vertical axis. Without the user having to move his or her hands, the razor blade unit according to the invention can compensate for a change in contour in a line parallel to the cutting edge by virtue of a simple movement of the razor blade unit.

It is further advantageously proposed that the razor blade unit can be mounted only by operating the handle, with the result that the razor blade unit does not have to be touched. A possible means of technical implementation consists, according to an advantageous proposal of the invention, in that the connecting device is formed by a four-bar linkage, of which one side can be swivelled about an axis which is essentially parallel to the swivel axis and intersects said side of the four-bar linkage. The four-bar linkage is basically a rectangle which is provided with joints at the four corners. If one side of the four-bar linkage is swivelled about an axis in a rocker-like manner, then the four-bar linkage is displaced in the manner of a parallelogram, with the result that the side located opposite the swivel side is swivelled in the same direction, to be precise about an imaginary axis passing through it. This mode of operation can be used to connect the razor blade unit to the four-bar linkage, thus automatically resulting in a capacity for swivelling about the swivel axis which intersects the cutting edge of the razor blade.

It is advantageously proposed that the axis intersects the side of the four-bar linkage at right angles. It is further advantageously proposed that the axis intersects the side of the four-bar linkage in the center. By variations in length of the individual four-bar-linkage sides, a vast range of possible ways of swivelling and adaptation to skin contours can be achieved.

It is advantageously proposed that the sides of the four-bar linkage are formed at least partly by bar elements. It is further proposed that the sides of the four-bar linkage are formed at least partly by plate-like elements. Consequently, the connecting device of the razor according to the invention can be configured in accordance with functional, technical and design aspects.

It is further advantageously proposed that the lengths of the sides of the four-bar linkage can be adjusted. It is still further advantageously proposed that the sides which adjoin the swivelled side of the four-bar linkage form a mounting device for the razor blade unit. These sides may, particularly advantageously, have hook-like elements. This measure permits the use of conventional, sufficiently known razor blade units which are provided with grooves and are mounted by latching in a hook-like element on the handle. Since the hook-like element is formed on the four-bar linkage, the razor blade unit is also automatically swivelled in the manner according to the invention when the corresponding side of the four-bar linkage is swivelled.

The fastening devices, known per se, with which razor blade units are fastened on the handle by means of hook-like elements themselves provide the razor blade unit with the capacity for swivelling about the axis formed by the hook-like elements. This capacity for swivelling may advantageously be supplemented by the additional capacity for swivelling according to the invention, as a result of which the shaving system becomes extremely effective and convenient to use.

It is advantageously proposed that at least one side of the four-bar linkage, preferably that side of the four-bar linkage which can swivel about the axis and, if appropriate, also the side located opposite this side, has at least one bending point. This measure means that a simple loading and unloading process can be carried out. By a corresponding exertion of pressure, one side or both sides bend in the region of their bending points, and this reduces the distance between the other two sides of the four-bar linkage. Since said other two sides are provided with a mounting device for the razor blade unit, the latter is disengaged or the mounting device can be inserted into the corresponding device of the razor blade unit. This measure means that the situation where the user has to come into contact with said razor blade units is avoided, which may be particularly advantageous in medical applications.

It is advantageously proposed that the four-bar linkage is spring-loaded in an initial position. If the razor according to the invention is moved along a skin contour for the purpose of shaving, the change in contour means that a different pressure is exerted on the razor blade unit, resulting in the initiation of the swivelling operation in order to yield to the respective pressure. By virtue of the spring loading, the four-bar linkage, and thus also the razor blade unit, returns as a rule into its initial position.

According to an advantageous proposal of the invention, a slide element is arranged as actuating device in the region of the four-bar linkage in order to allow for the bending inward of the at least one side provided with a bending point. Said slide element is advantageously spring-loaded. It can be readily comprehended that such a slide element, for example arranged on a base plate, exerts pressure, by displacement counter to the spring force, on the bending point of the at least one side provided with the bending point, and bends in said side. Via the respective joints, the two sides connected to the bent-in side are then moved towards one another, with the result that the mounting device is actuated. By virtue of the spring loading, the slide element moves back into the initial position after release. It is further advantageously proposed that there is arranged in the mounting region for the razor blade unit an abutment for the second swivel plane. This abutment comprises, for example, a running surface on which the razor blade unit, in the event of a swivel movement, runs about the axis formed by the hook-like elements. Said abutment is advantageously spring-loaded. It is particularly advantageously proposed that the abutment for the second swivel plane is mounted such that it is spring-loaded with respect to the slide element. Consequently, the two components can simply be integrated locally and linked functionally to one another.

Furthermore, the invention proposes a connecting device which can be used to connect a razor blade unit to a handle and may have the features described. According to an advantageous proposal of the invention, the connecting device is fastened on the razor blade unit. Such razor blade units can be provided in corresponding dispensers, with the result that they can easily be arranged on a handle by means of the connecting device. According to an alternative proposal of the invention, the connecting device is fastened on the handle. This measure promotes the use of conventional razor-blade assemblies, a corresponding mounting device being formed in the region of the four-bar linkage.

The razor according to the invention and the use of the connecting device according to the invention permit an improved shave due to the improved ability to follow irregular surfaces which are to be shaved. The closeness of the cutting edges to the surface which is to be shaved is likewise improved, as is the optimization of the cutting angle. Furthermore, said improved following ability means that, as a rule, a larger cutting-edge width can be used, which likewise improves the shaving convenience since the pressure to be exerted on the body to be shaved can be controlled with good effect. Furthermore, said pressure can further be varied by spring-loaded mechanisms. The razor according to the invention is extremely ergonomic and produces excellent shaving results since adjustment compensation by the user is avoided.

Further advantages and features of the invention are given in the following description with reference to the figures, in which.

DETAILED DESCRIPTION OF THE PREFERRED EMBODIMENTS

Figure 1:
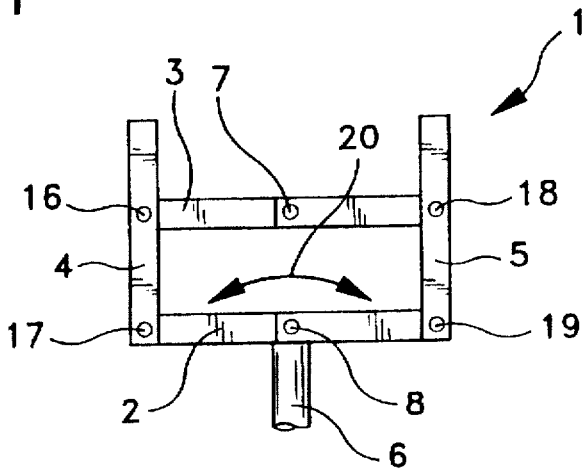
FIG. 1 shows a schematic representation of a four-bar linkage.
Figure 2:
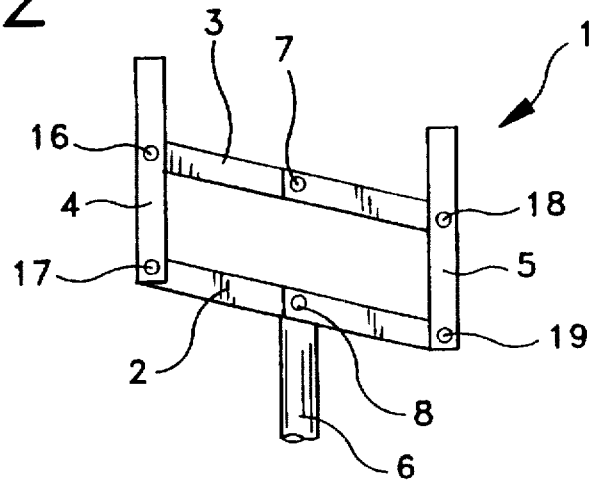
FIG. 2 shows a schematic representation of the four-bar linkage according to FIG. 1 in a swivelled position.
Figure 3:
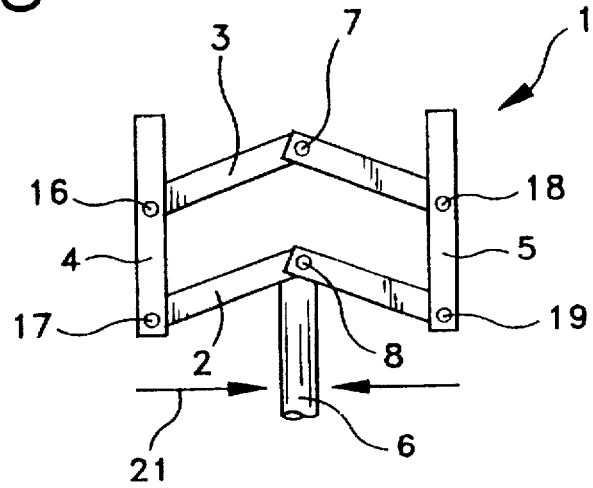
FIG. 3 shows a schematic representation of the four-bar linkage according to FIG. 1 in a bent position.

The connecting device represented schematically in FIGS. 1 to 3 is in the form of a four-bar linkage 1 which comprises a base bar 2, an opposing bar 3 located opposite bar 1, and the side bars 4 and 5 which connect bars 2, 3. Pivot joints 16, 17, 18 and 19 are arranged in each case at the points of connection between the bars 2, 3, 4 and 5. The base bar 2 is arranged on the handle 6 such that it can be swivelled in the direction of the swivelling-direction arrow 20, with the result that swiveling of the base bar 2 in the manner shown in FIG. 2 causes the bar 3 located parallel to the base bar 2 to swivel. The variation in length of the individual bars can affect corresponding swivel displacements.

The base bar 2 and the opposite bar 3 have bending joints 7, 8, with the result that the side bars 4, 5 move towards one another in the direction of the movement-direction arrows 21 when the bending joints 7 and 8 are bent in. It is also possible to provide the side bars 4 and 5 with bending points, so that these can be bent outward, as a result of which the free ends of the two bars move towards one another.

A corresponding razor blade unit having at least one cutting edge can be arranged at the free ends of the side bars 4 and 5, which razor blade unit can be swivelled in a manner corresponding to the bars 2 and 3, the swivel point lying essentially on the cutting edge.

The longitudinal extent of the four-bar linkages can be formed from bar elements, for example, over the length of a razor blade unit, which four-bar linkages can be connected to one another by rods, which can form the pivot joints, or a common plate-like base on the base bar 2 or bar 3, in order to carry out uniform movements. The only essential factor is that one base bar 2 of one four-bar linkage 1 is arranged such that it can swivel relative to the handle.

Figure 4:
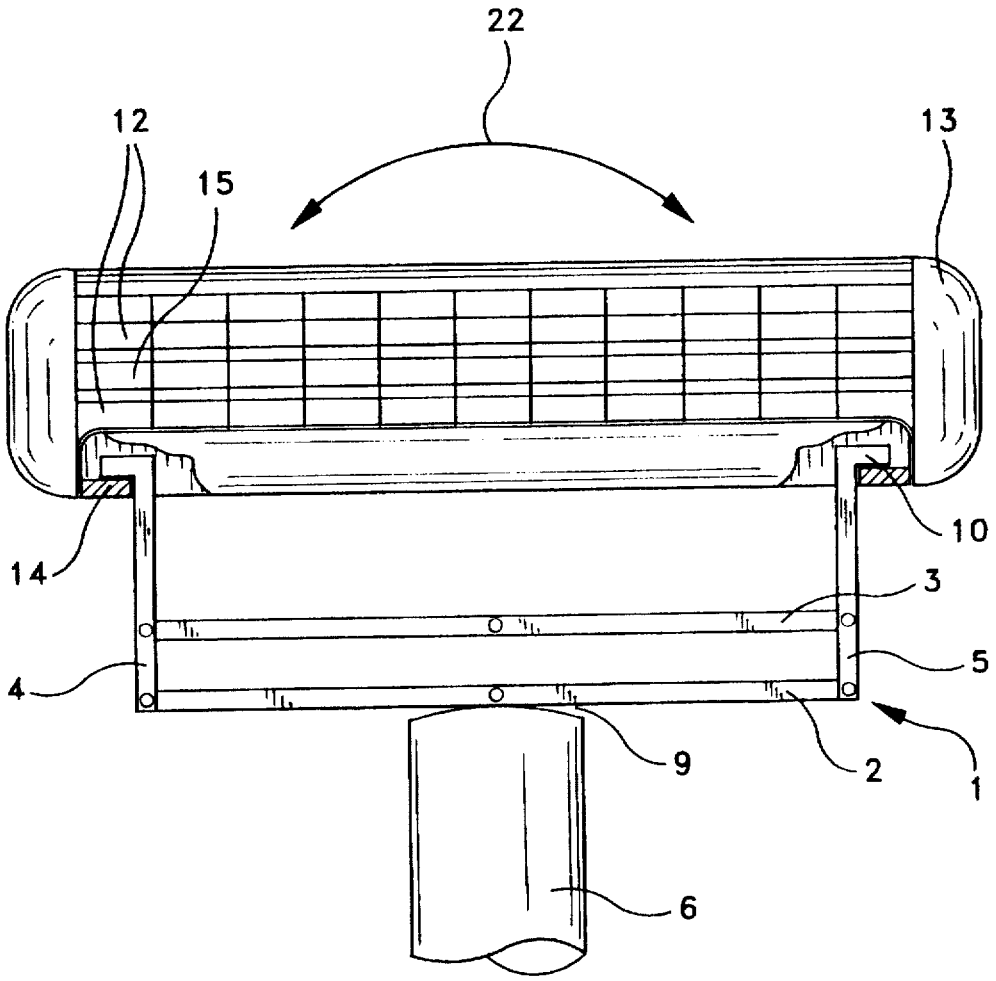
FIG. 4 shows a schematic view of an exemplary embodiment for a razor.

In the exemplary embodiment shown in FIG. 4, the free ends of the side bars 4 and 5 of the four-bar linkage 1 are provided with hook elements 10, so that they can be inserted into the latching grooves 14 of a razor blade unit, as a result of which the razor blade unit is fastened swivellably on the handle 6 in the manner described. The razor blade unit 11 can be removed from the handle again 6 simply by bending the bars 2 and 3. A corresponding actuating button can be provided for bending the bending joints 7 and 8.

In the exemplary embodiment shown, the razor blade unit 11 has a double razor blade 12, comprising two individual razor blades which are arranged in housing 13. A spacer 15 is arranged between the razor blades. The double razor blade assembly may, for its part, be arranged movably in the housing 13, with the result that different possible movements can occur simultaneously.

The razor blade unit 11 can be swivelled as indicated by the swivelling-direction arrow 22. The pivot point lies in the region of the cutting edge of the respective razor blade, resulting in optimum shaving properties.

Figure 5:
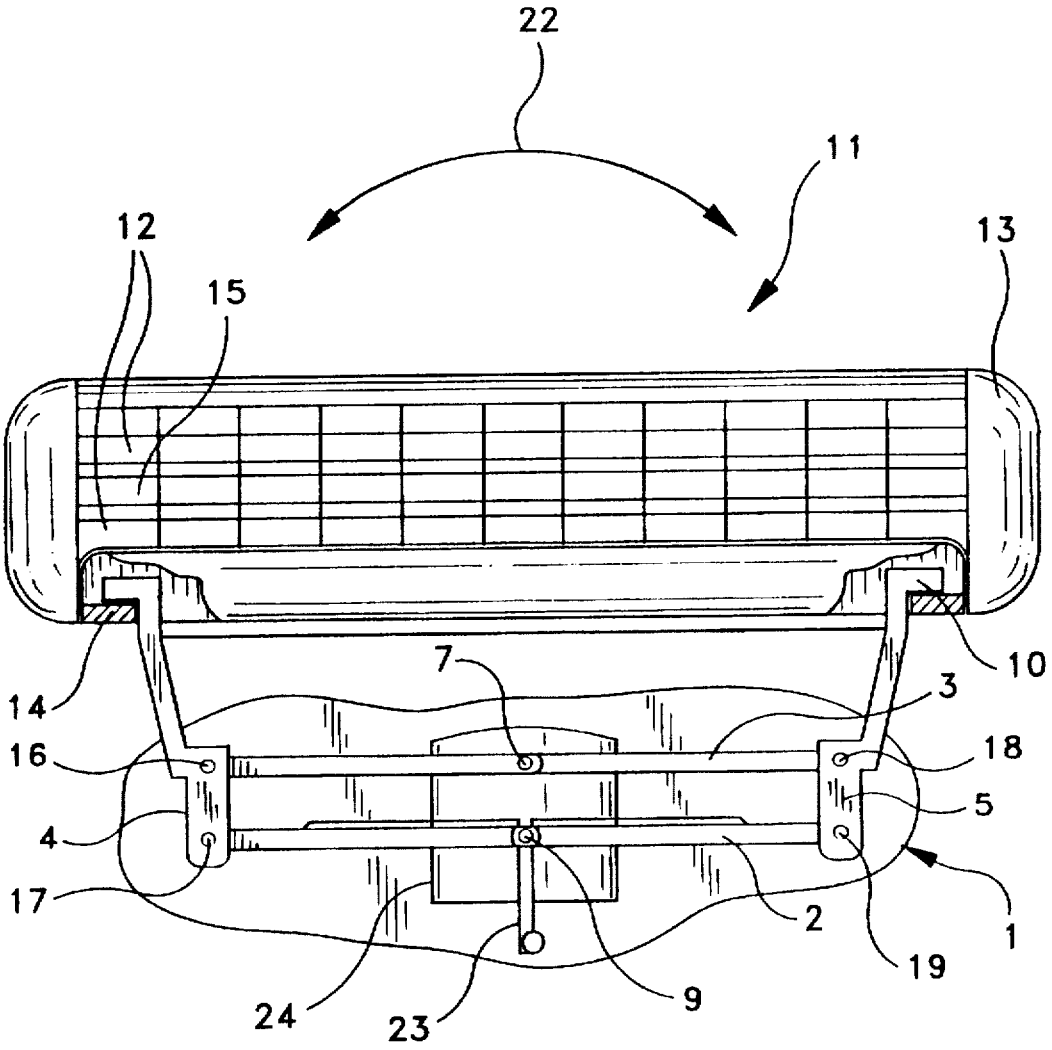
FIG. 5 shows a schematic representation of an exemplary embodiment of a four-bar linkage.

A comparatively specific representation of an exemplary embodiment of a four-bar linkage is shown in FIG. 5. Here too, the four-bar linkage 1 is formed from the base bar 2 and the bars 3, 4 and 5. The side bars 4 and 5 are extended beyond the joints 16, 18 and have hook elements at the end. The bar 3 can be bent in the central region of the bending joint 7. The bar 2 cannot be bent in and is mounted on the bearing region 9. A spring 23 acts on the four-bar linkage in the region of the base bar 2 such that, after swivelling about the bearing 9, said base bar 2 returns into the neutral position again. A slide element 24 can, by moving into a position where the slide element abuts the joint, exert pressure on the bending joint 7 of the bar 3 and thus bend in same. Consequently, the side bars 4 and 5 are moved towards one another, the same applying for the hook elements 10.

Figure 6:
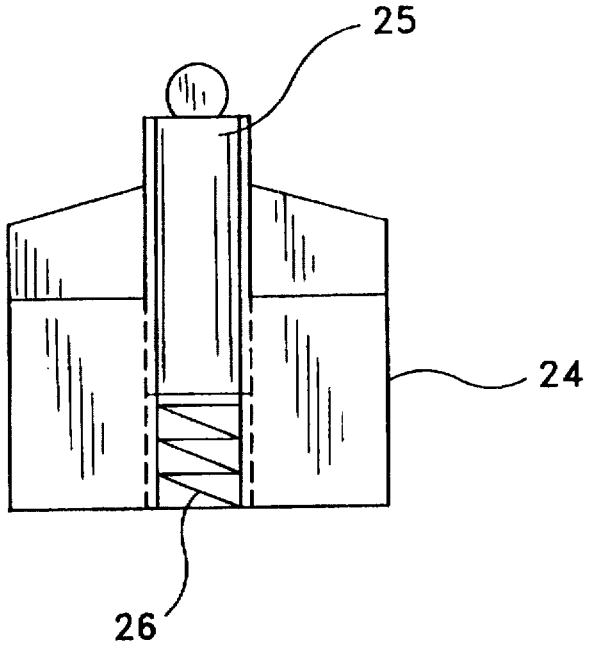
FIG. 6 shows a plan view of an exemplary embodiment of a slide element.
Figure 7:
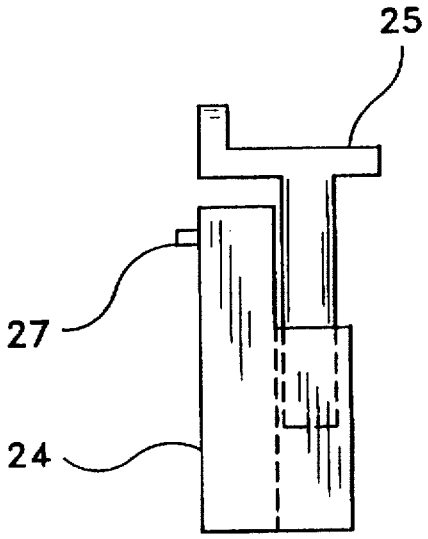
FIG. 7 shows a side view of the slide element according to FIG. 6.

An exemplary embodiment of the slide element is shown in FIGS. 6 and 7. The slide element 24 comprises an essentially plate-like element with a longitudinal groove in which the bearing slide 25 is inserted such that it can be displaced longitudinally. The bearing slide 25 and slide element 24 are loaded with respect to one another by the helical spring 26. It is thus sufficient to position one of the two longitudinally displaceably, within a certain region relative to the four-bar linkage, with the result that the other in each case remains movable relative thereto. In the exemplary embodiment shown, the slide element 24 is provided with a lug 27 which can be used as bending joint or exert pressure on the bending joint.

The bearing slide 25 projects beyond the four-bar linkage in the direction of the razor blade unit and constitutes a swivel stop for the swivelling of the razor blade unit about the axis formed by the hook element 10. This improves the swivelling characteristics.

Figure 8:
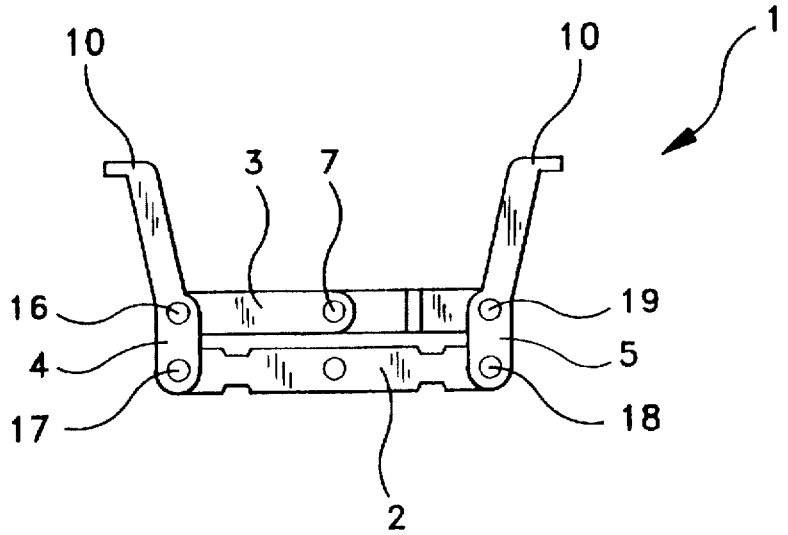
FIG. 8 shows a representation of a further exemplary embodiment of a four-bar linkage.
Figure 9:
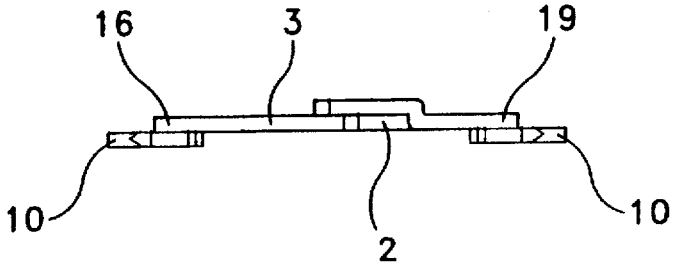
FIG. 9 shows a plan view of the four-bar linkage according to FIG. 8.
Figure 10:
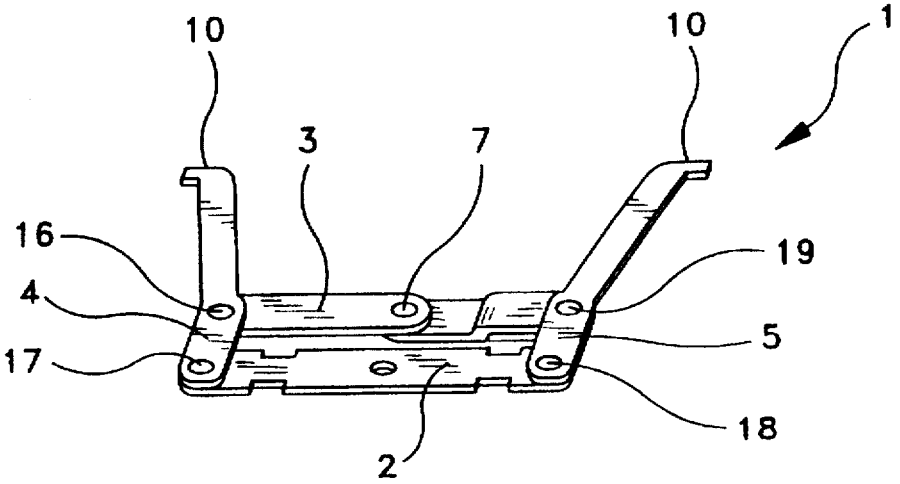
FIG. 10 shows a perspective view of the four-bar linkage according to FIG. 8.

Comparatively specific representations of an embodiment of a four-bar linkage are shown in FIGS. 8 to 12. FIG. 8 is a view of the four-bar linkage 1, comprising the base bar 2 and the apposite bar 3 provided with a bending joint 7. In order to permit satisfactory and simple bending, part of the bar 3 is provided with an offset portion 40. The bars 2 and 3 are connected at the two ends to the side bars 4 and 5 via the joints 16, 17, 18 and 19. By bending in the bar 3 at the bending joint 7, the hook elements 10 arranged at the end of the side bars 4 and 5 can thus be moved.

Figure 11:
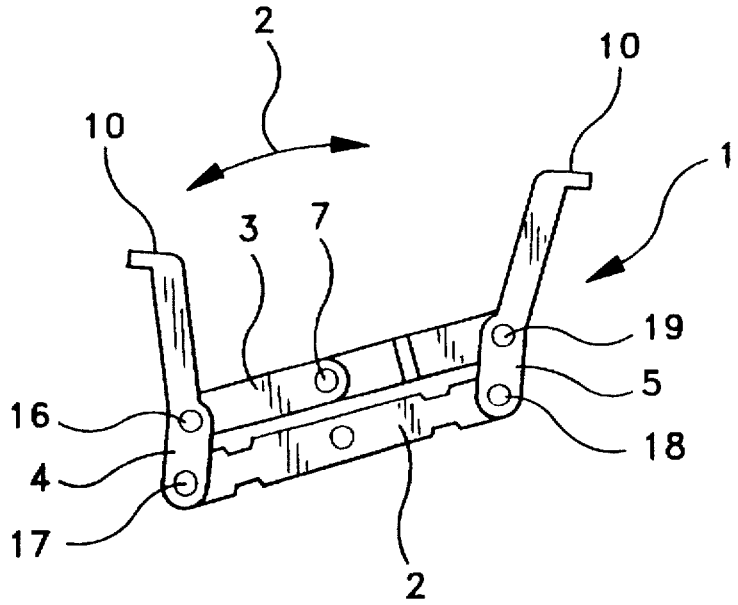
FIG. 11 shows a representation of the four-bar linkage according to FIG. 8 in a different working position.

FIG. 11 shows a representation of said exemplary embodiment of the four-bar linkage in a swivelled-out position, with the result that a razor blade unit fastened on hook elements 10 is swivelled about an axis which essentially intersects the cutting edge of the razor blade, the intention being for this also to comprise a position within a tolerance range about the cutting edge.

Figure 12:
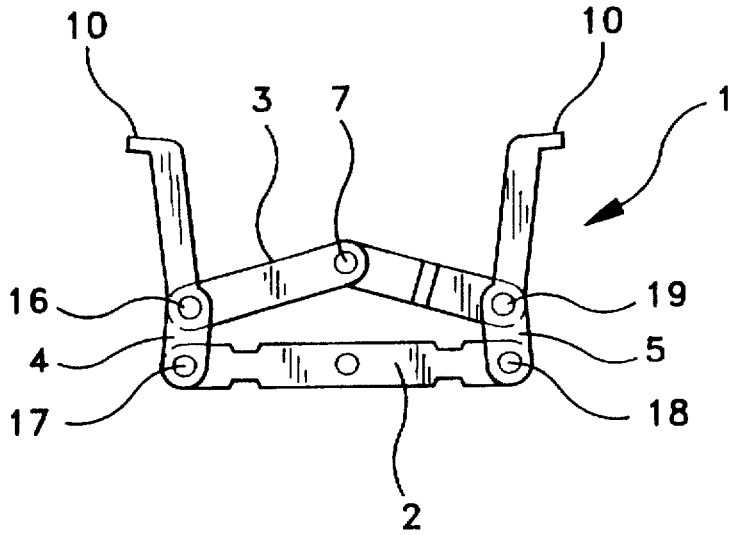
FIG. 12 shows a representation of the four-bar linkage according to FIG. 8 in a different working position.
Figure 13:
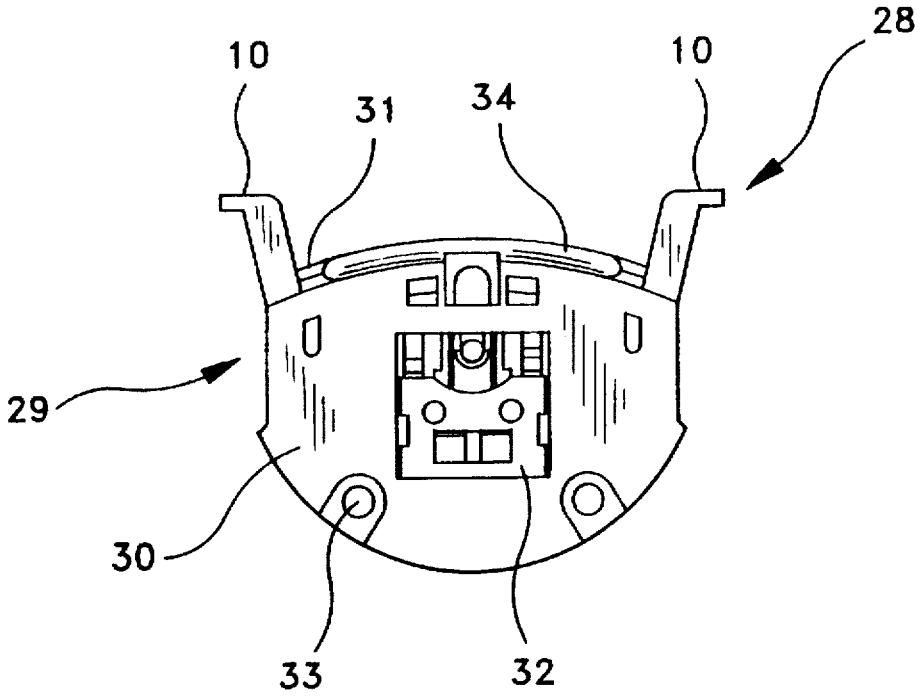
FIG. 13 shows a representation of an exemplary embodiment of a fastening unit.
Figure 14:
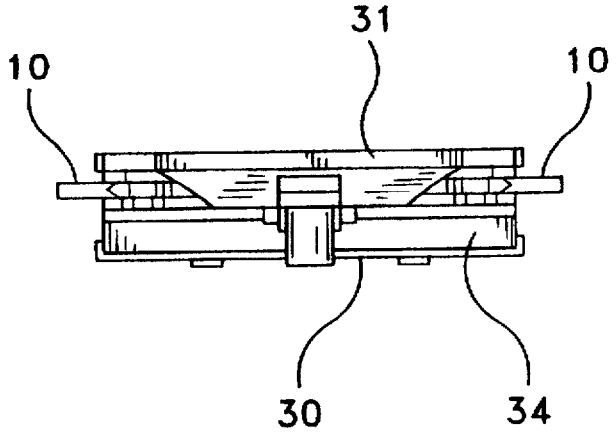
FIG. 14 shows a representation according to FIG. 13, in plain view.
Figure 15:
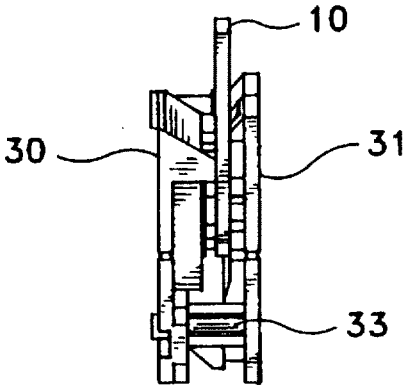
FIG. 15 shows a representation according to FIG. 13, in side view.
Figure 16:
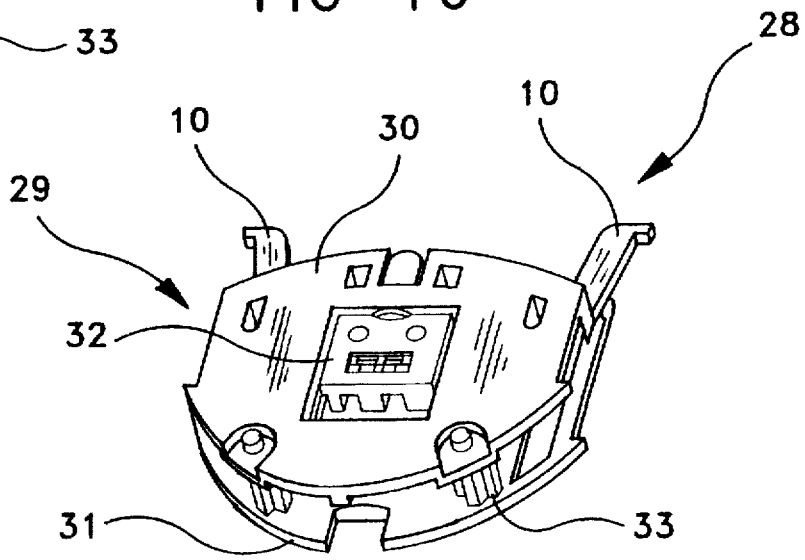
FIG. 16 shows a representation according to FIG. 13, in perspective view.

FIG. 12 shows the disengaging position of the four-bar linkage, the bar 3 having been bent in at the bending joint 7 and hook elements 10 thus having been moved relative to one another, the distance between them being reduced in the process.

Figure 17:
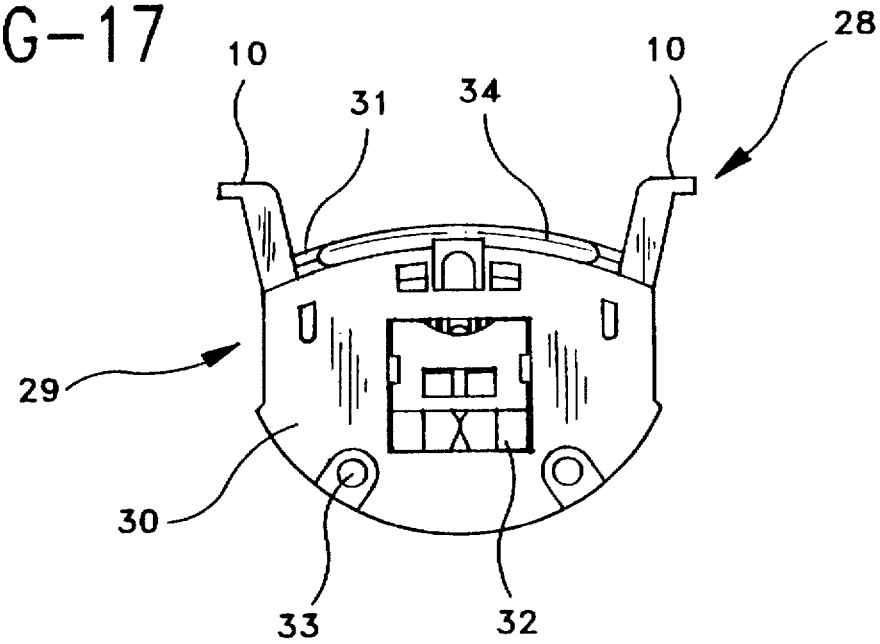
FIG. 17 shows a representation according to FIG. 13, in a different operating state.

FIGS. 13 to 17 show an embodiment of an actuating device which is designed as a modular assembly in the manner of a lock 28. The lock 28 comprises a housing 29 in which a four-bar linkage with the hook elements 10 is arranged such that it can be moved, that is to say such that it can swivel about a pivot axis in the base side. This may be, for example, a four-bar linkage as shown in FIGS. 8 to 12. The housing 29 comprises an upper plate 30 and a lower plate 31, the upper plate having a recess in which a slide 32 is arranged such that it can be moved back and forth. The slide is spring-loaded in its retracted position. The four-bar linkage is mounted such that it can be swivelled in the manner described and, by pushing the slide 32 forwards, the hook elements 10 are moved relative to one another, by a bending point in the bar 3 being bent in, the distance between hook elements being reduced in the process. This position is shown in FIG. 17.

The plates 30 and 31 are kept at a distance from one another by screws 33 or other spacing fastening means and have, at the front end, a front plate 34 which at least partially covers the region.

I claim:

1. A razor unit having one or more razor blades, with each razor blade having a cutting edge, and a connecting device for connecting the razor blade unit to a handle, wherein the razor blade unit is mounted on the handle such that the unit is capable of swivelling in two directions to form a swivel angle relative to the handle about a swivel axis which intersects the cutting edge of the one or more razor blades and wherein the connecting device comprises at least one four-bar linkage having four sides, of which one side is arranged essentially parallel to the cutting edge and is mounted such that said side can be swivelled about an axis which is essentially parallel to the swivel axis and intersects said one side of the four-bar linkage at right angles in the center of said one side.

2. The razor unit according to claim 1, wherein the swivel angle in each of the two directions is between 0 and 80.

3. The razor unit according to claim 2, wherein the swivel angle in each of the two directions is between 5 and 20.

4. The razor unit according to claim 3, wherein the razor blade unit comprises a double razor blade assembly.

5. The razor unit according to claim 4, wherein the razor blade unit is mounted to the handle.

6. The razor unit according to claim 5, wherein at least one of the four sides is formed by bar elements.

7. The razor unit according to claim 5, wherein at least one of the four sides is formed by plate-like elements.

8. The razor unit according to claim 5, wherein the at least one side is longitudinally displaceable.

9. The razor unit according to claim 5, wherein a mounting device for the razor blade unit is attached to the sides which are connected to the side which is swivellable in a swivel plane about an axis which is essentially parallel to the swivel axis.

10. The razor unit according to claim 9, wherein the mounting device comprises hook elements for the attachment of a razor blade unit.

11. The razor unit according to claim 5, wherein the four-bar linkage comprises joints at the intersections of the four bars and the at least one side of the our-bar linkage has bending joints located between the joints.

12. The razor unit according to claim 11, wherein the razor unit further comprises a slide element to facilitate bending inward of the at least one side provided with the bending joint.

13. The razor unit according to claim 12, further comprising a bearing slide and wherein the slide element is spring-loaded with respect to the bearing slide.

14. The razor unit according to claim 5, wherein the four-bar linkage is in contact with a spring for returning the four-bar linkage to a neutral position.

15. The razor unit according to claim 9, wherein an abutment for the swivelling of the razor blade unit in the swivel plane is formed adjacent to the mounting device.

16. A connecting device for connecting a razor blade unit having one or more blades with each blade having a cutting edge, to a handle comprising at least one four-bar linkage having four sides, of which one side can be swivelled about an axis which intersects said side of the four-bar linkage and is essentially parallel to a swivel axis which intersects the cutting edge of the one of more cutting edges.

17. A connecting device according to claim 16, wherein the connecting device is fastened on the handle.

* * * * *